US006041535A

United States Patent [19]

Holloway et al.

[11] Patent Number: 6,041,535

[45] Date of Patent: Mar. 28, 2000

[54] FLEXIBLE SIGN RETENTION AND TENSIONING FRAME ASSEMBLY

[75] Inventors: Graham F. Holloway, St-Lazare; Wolfe Vracar, Charlottenburg, both of Canada

[73] Assignee: Graewolf Mobile Media Communications Inc., Quebec, Canada

[21] Appl. No.: 08/792,385

[22] Filed: Feb. 3, 1997

Related U.S. Application Data

[63] Continuation of application No. 08/495,898, Jun. 28, 1995, abandoned.

[51] Int. Cl.[7] ..... G09F 17/00

[52] U.S. Cl. ..... 40/603; 160/328; 40/590

[58] Field of Search ..... 40/603, 580, 590, 40/591, 604; 160/328

[56] References Cited

U.S. PATENT DOCUMENTS

| | | | |
|---|---|---|---|
| 2,415,200 | 2/1947 | Willett et al. | 160/328 |
| 2,546,302 | 4/1951 | Blaset | 160/328 |
| 4,580,361 | 4/1986 | Hillstrom et al. . | |
| 4,756,107 | 7/1988 | Hillstrom . | |
| 4,862,615 | 9/1989 | Hillstrom . | |
| 4,922,988 | 5/1990 | Loomis | 40/603 X |
| 5,058,299 | 10/1991 | Suzuki . | |
| 5,239,765 | 8/1993 | Opdahl . | |
| 5,245,774 | 9/1993 | Huber . | |

*Primary Examiner*—Cassandra H. Davis
*Attorney, Agent, or Firm*—Klauber & Jackson

[57] ABSTRACT

A retention and tensioning frame assembly is used to securely and tautly mount a flexible sign, such as an advertisement display panel, to the side of a truck or of the semi-trailer of a tractor trailer. The frame assembly can be used to secure any flexible sheet-like panel to a flat surface, e.g. a billboard. The frame assembly comprises a series of frame sections which define a slightly open longitudinal cylinder adapted to receive therein a peripheral bead of the sign. The frame sections are adapted to be fixedly mounted to a side wall of the semi-trailer or the like thereby securing the sign to the side wall. Each frame section defines at an outer edge thereof opposite its cylinder an inturned lip which can be engaged by a pulling device for outwardly pulling on the sign, one side at a time, for tautly tensioning the sign. The frame sections, once engaged to the sign, are normally loosely attached to the side wall, and then the sign is tensioned using the pulling device before the frame sections are tightly secured to the side wall with the sign being taut.

25 Claims, 3 Drawing Sheets

FLEXIBLE SIGN RETENTION AND TENSIONING FRAME ASSEMBLY

This Application is a Continuation of application Ser. No. 08/495,898, filed Jun. 28, 1995 abandoned.

BACKGROUND OF THE INVENTION

1. Field of the Invention

The present invention relates to advertising displays or signs for use on the sides of a truck or of a tractor trailer such as a semi-trailer and, more particularly, to a retention and tensioning frame assembly for securely and tautly mounting such displays or signs to a flat panel.

Various signs and displays are presently used as advertisements on the sides of vehicles, e.g. trucks and tractor trailers, on billboards, on buildings, etc. The signs typically exhibit their advertisement on a large canvas or plastic display panel which is secured to a flat surface by way of various mounting systems. Furthermore, for various reasons including, in the case of signages used on trucks or semi-trailers, the wind forces to which are exposed the signs, it is necessary that the flexible signs be mounted under substantial tension. Accordingly, various tensioning devices have been provided with the signage mounting systems for tautly retaining the signs on different flat surfaces.

2. Description of the Prior Art

For instance, U.S. Pat. No. 4,580,361 issued to Hillstrom et al. on Apr. 8, 1986 discloses a display tensioning frame for holding display panels, wherein the panels are secured in tension at their peripheral edges by spring-biased slide means. The slide means can be displaced between display panel changing and securing positions by way of pivoted covers which tension the springs in the display panel securing position and which substantially release the spring pressure in the display panel changing position.

U.S. Pat. No. 4,756,107 issued to Hillstrom on Jul. 12, 1988 discloses a sign retention and tensioning frame for securely retaining a sign on all of its edges while allowing for expansion and contraction of the sign. The frame includes a series of elongated frame sections each having a base member and a cover member hingedly and pivotally connected thereto with at least one slide member being mounted inside the base member for displacement parallel to the sign. Each slide member includes a post member adapted to extend through a respective aperture provided in the peripheral edge of the sign with a retainer member being pivotally mounted to the slide member for movement into and out of interlocking engagement with the post for reinforcing the same and for securely retaining the sign in place during installation.

U.S. Pat. No. 4,862,615 issued to Hillstrom on Sep. 5, 1989 discloses a releasable anchoring and tensioning system for mounting a sign in the form of a sheet material on a panel structure. The system comprises a channel-shaped base member secured to the rear of the panel structure and including a ratcheted clip member slidably connected thereto. The clip member is ratcheted for tensioning the sheet material, or alternatively relaxing the same, using a lever-type tool such as a flat head screwdriver.

U.S. Pat. No. 5,058,299 issued to Suzuki on Oct. 22, 1991 discloses an advertising device which includes a rail member defining a circular channel which is almost closed asides from a longitudinal slit defined therein and which has a thickness slightly larger than that of the flexible sheet of the display sign. The display sign includes a peripheral cylindrical enlargement or bead which is adapted to be received in the channel of the rail member, whereby a number of such rail members can be used for securing the upper and lower edges of the display sign to a flat surface.

U.S. Pat. No. 5,239,765 issued to Opdahl on Aug. 31, 1993 discloses an advertising display provided with a self-tensioned display panel which comprises elongated peripheral stays which are preferably formed of aluminum. These stays are adapted to be retained adjacent to the surface onto which the display panel is being secured by way of retainers fixedly mounted to this surface and defining lips spaced apart from the surface so that the stays are partly imprisoned between the lips of the retainers and the surface.

U.S. Pat. No. 5,245,774 issued to Huber on Sep. 21, 1993 discloses a tensioning system for a flexible sign which comprises a retaining member for the periphery of the flexible sign, the retaining member defining a U-shaped channel which is adapted to be engaged by a L-shaped extension of a tensioning member. The tensioning member includes a catch adapted to mate with a series of ridges defined on the frame of the system so as to provide more or less tension to the flexible sign.

SUMMARY OF THE INVENTION

It is therefore an aim of the present invention to provide an improved and novel retention and tensioning frame assembly for securing a flexible sign to a flat surface, such as the side of a truck or of a semi-trailer, a billboard, etc.

It is also an aim of the present invention to provide an improved and novel method for securing and tensioning the flexible sign or the like to a flat surface.

Therefore, in accordance with the present invention, there is provided a frame assembly for retaining a flexible sheet-like panel or the like to a substantially flat surface, comprising a series of frame means adapted to be attached at an inner edge thereof to peripheral edges of the panel and adapted to be loosely secured to the flat surface, said frame means being adapted for being pulled outwardly of the panel for tensioning the same when said frame means are loosely secured to the panel, said frame means being further adapted to be fixedly secured to the panel once the sign has been sufficiently tensioned.

Also in accordance with the present invention, there is provided a method for attaching flexible sheet-like panel or the like to a substantially flat surface, comprising the steps of providing a frame assembly comprising a series of frame means; attaching said frame means at an inner edge thereof to peripheral edges of the panel; loosely securing said frame means to the flat surface; pulling said frame means outwardly of the panel for tensioning the same; fixedly securing said frame means to the panel.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
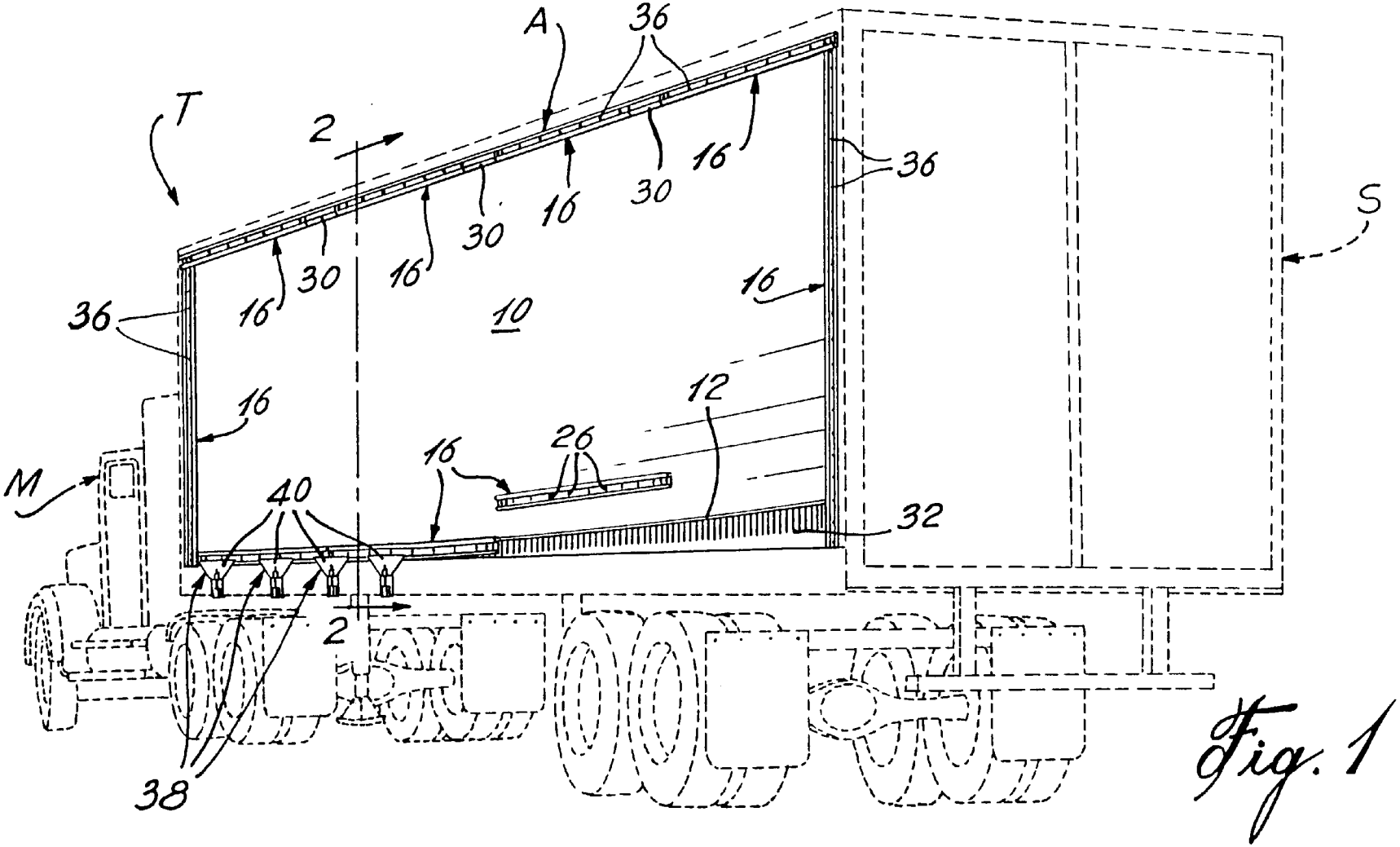
FIG. 1 is a perspective view of a retention and tensioning frame assembly in accordance with the present invention including its flexible sign, wherein the frame assembly and the flexible sign are shown in the process of being secured to a side of the semi-trailer of a tractor trailer shown in phantom lines.

FIG. 1 is a perspective view showing in phantom lines a tractor trailer T which includes a motor truck or tractor truck and a semi-trailer S rigged thereto. In full lines, there is shown on a left side of the semi-trailer S a frame assembly A in accordance with the present invention and a flexible sign 10 intended to be secured by the frame assembly A to the semi-trailer S. In FIG. 1, the frame assembly A and the flexible sign 10 are shown in the process of being secured to the semi-trailer S.

Figures 2, 4, 5:
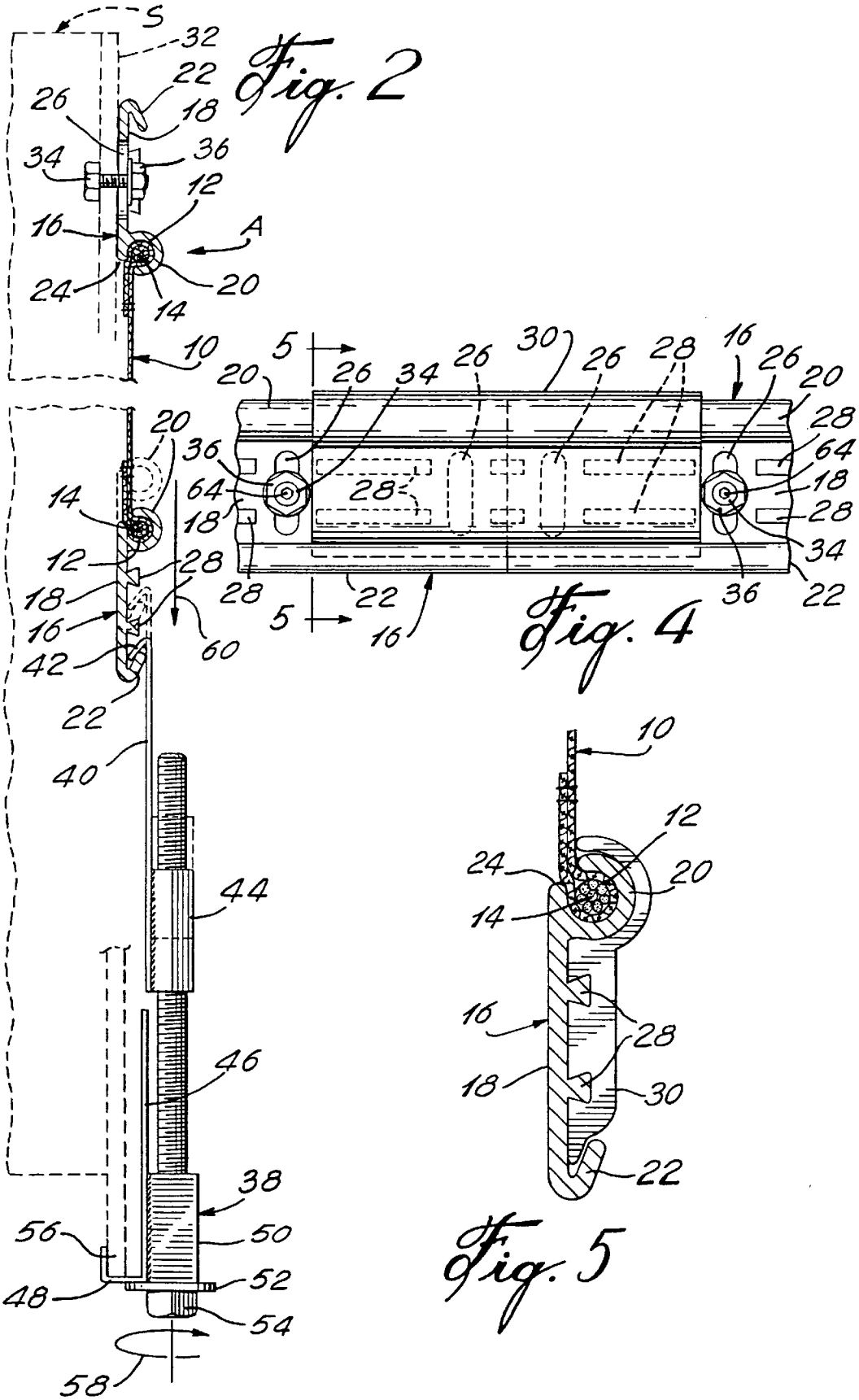
FIG. 2 is an interrupted cross-sectional view taken along line 2—2 of FIG. 1 and showing the flexible sign in the process of being tensioned by the frame assembly of the present invention.
FIG. 4 is a schematical elevational view of part of the frame assembly of the present invention, wherein there is shown a slide engaged on a pair of abutting frame sections of the present frame assembly.
FIG. 5 is a cross-sectional side view taken along line 5—5 of FIG. 4 which shows the slide engaged on a frame section.
Figure 6:
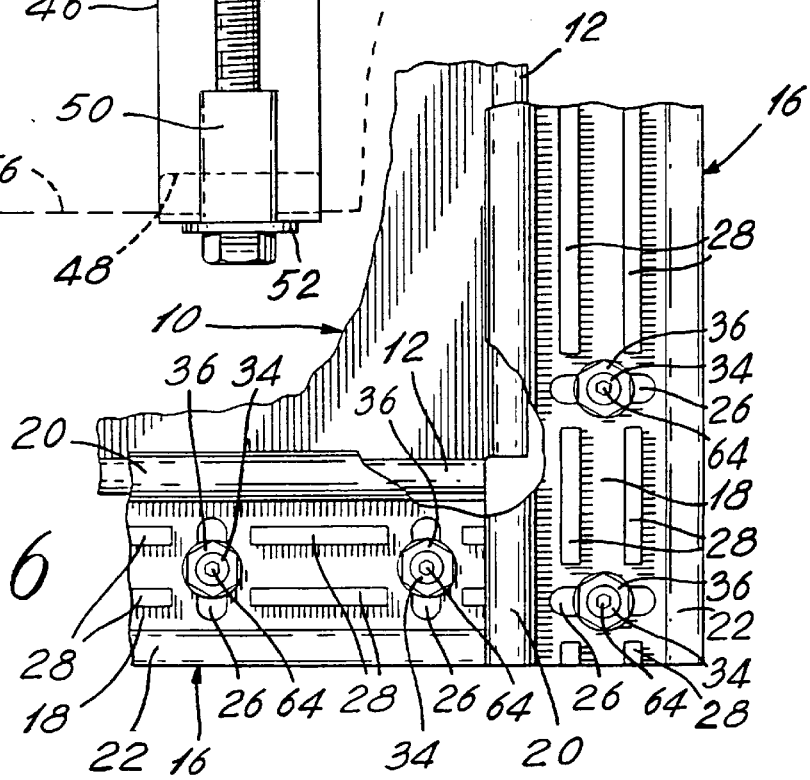
FIG. 6 is a fragmented elevational view showing a lower corner of the frame assembly of the present invention and a corner of the flexible sign.

The flexible sign 10 is made of a fiber reinforced polymer and defines along each of the peripheral edges thereof a beading 12 which is best seen in FIGS. 2 and 5. In the present embodiment, the beading 12 is made by providing a bead 14 in the form of a strong rope (as shown) or a plastic pipe (as proposed) having a diameter of approximately ⅛ inch and positioning this bead 14 near the periphery of the flexible sign 10 so that the flexible sign 10 can be folded over the bead 14 with overlapping fabric portions of the flexible sign 10 being then sewn in order to imprison the bead 14 therein, thereby forming the beading 12. The bead 14 must be rigid enough in order that it cannot be easily deformed for reasons which will become obvious hereinafter. As seen in FIG. 6, the beading 12 is interrupted at the corners of the flexible sign 10 also for reasons which will become more obvious hereinbelow.

The frame assembly A comprises a series of frame sections 16 (made of extruded aluminum) which are of substantially identical configuration although of varied lengths. In the embodiment shown in FIG. 1, the two vertical sides of the frame assembly A will each require a single frame section 16, whereas the upper and lower sides of the frame assembly A will each necessitate four (4) frame sections 16 disposed in an aligned end-to-end relationship. As best seen in FIGS. 2, 4 and 5, each frame section 16 includes a flat web 18, a bead receiving cylinder 20 at an inner edge of the flat web 18, and a V-shaped inturned lip or hook 22 at an opposite outer edge thereof. The bead receiving cylinder 20 is adapted to accommodate therein the beading 12 while allowing the flexible sign 10 to extend through the cylinder 20 at a longitudinal slit 24 defined inwardly and rearwardly thereof. Each frame section 16 also includes a series of transversely oriented oblong openings 26 defined on the flat web 18 of the frame section 16, that is between the bead receiving cylinder 20 and the inturned lip 22 thereof. For instance, on a twelve foot frame section 16, there can be a central oblong opening 26 and eight (8) more openings 26 symmetrically defined on each side of this central opening. The first four (4) openings 26 on each side of the central opening can be spaced from one another by 10 inches center-to-center, with the next four (4) openings 26 on each side being distanced in order, outwardly towards the longitudinal end of the frame section 16, by twelve (12) inches, eight (8) inches and five (5) inches twice (all distances are center-to-center), with the last opening having its center located at two (2) inches from the end of the frame section 16.

A pair of parallel elongated and longitudinally oriented dove-shaped ribs 28 extend on the flat web 18 of the frame section 16 between the oblong openings 26 thereof, with the ribs 28 extending on a same side of the flat web 18 as the cylinder 20 and the lip 22. It is noted that the ribs 28 are produced during the extrusion of the frame section 16, whereby they first extend uninterrupted the complete length of the frame section 16. Where the oblong openings 26 are to be provided along the frame section 16, the ribs 28 are taken off as well as around the oblong openings 26 in order to provide clearance to accommodate nuts which will cooperate with bolts extending through the oblong openings 26 for securing the flexible sign 10 to the semi-trailer 5, as it will be described in more details hereinafter.

The frame assembly A also comprises a series of slides 30 made of extruded aluminum and which each have a shape complementary to that of the cylinder 20, lip 22 and ribs 28 of the frame section 16 as best seen in FIG. 5. Accordingly, the slide 30 can be slidably displaced along the frame sections 16 in view of the complementary dovetail-shaped tongue and groove arrangements which further prevent the slides 30 from disengaging from the frame sections 16. The slide 30 is used to cover abutting ends of any pair of aligned frame sections 16.

A panel or wall 32 of the semi-trailer S can define outwardly thereof threaded holes for receiving bolts which will be used to secure the frame sections 16 to the semi-trailer S. However, in the present embodiment, the wall 32 of the semi-trailer S defines circular openings through which the bolts will extend from inside out with nuts being provided on the outside of the wall 32 for engagement with the bolts so as to secure the frame sections 16 to the wall 32.

To typically install the flexible sign 10 using the frame assembly A of the present invention, an appropriate number of frame sections 16 (in the present embodiment four such sections 16 are required) are engaged at their bead receiving cylinders 20 around the upper peripheral beading 12 of the flexible sign 10. At each of the three abutment areas of these upper frame sections 16, there is provided a slide 30. With the upper beading 12 properly and securely engaged in the bead-receiving cylinders 20 of the upper frame sections 16, the upper frame sections 16 are secured to the wall 32 of the semi-trailer S by way of bolts 34 and nuts 36 each having a washer integral therewith (see FIG. 2), whereby the upper edge of the flexible sign 10 is fixedly secured to the wall 32. Then, an appropriate frame section 16, i.e. of sufficient length, is engaged over the beading 12 of one of the vertical edges of the flexible sign 10. The frame section 16 is then loosely secured to the wall 32 of the semi-trailer S by way of bolts 34 and nuts 36. The flexible sign 10 is then stretched by using a device which is engaged on the inturned lip 22 of the vertical side frame sections 16 and which is adapted to pull the frame section 16 outwardly, that is away from the flexible sign 10 so as to tension the same. The bolts 34 and nuts 36 are then used to fixedly secure this frame section 16 to the semi-trailer S. The same operation is then carried out for the other vertical edge of the flexible sign 10, whereby the flexible sign 10 is longitudinally taut. The longitudinal tensioning of the flexible sign 10 is allowed by the upper beading 12 of the flexible sign 10 which can horizontally displace along the cylinders 20 of the upper frame sections 16 during the pulling of the vertical end frame sections 16.

Figure 3:
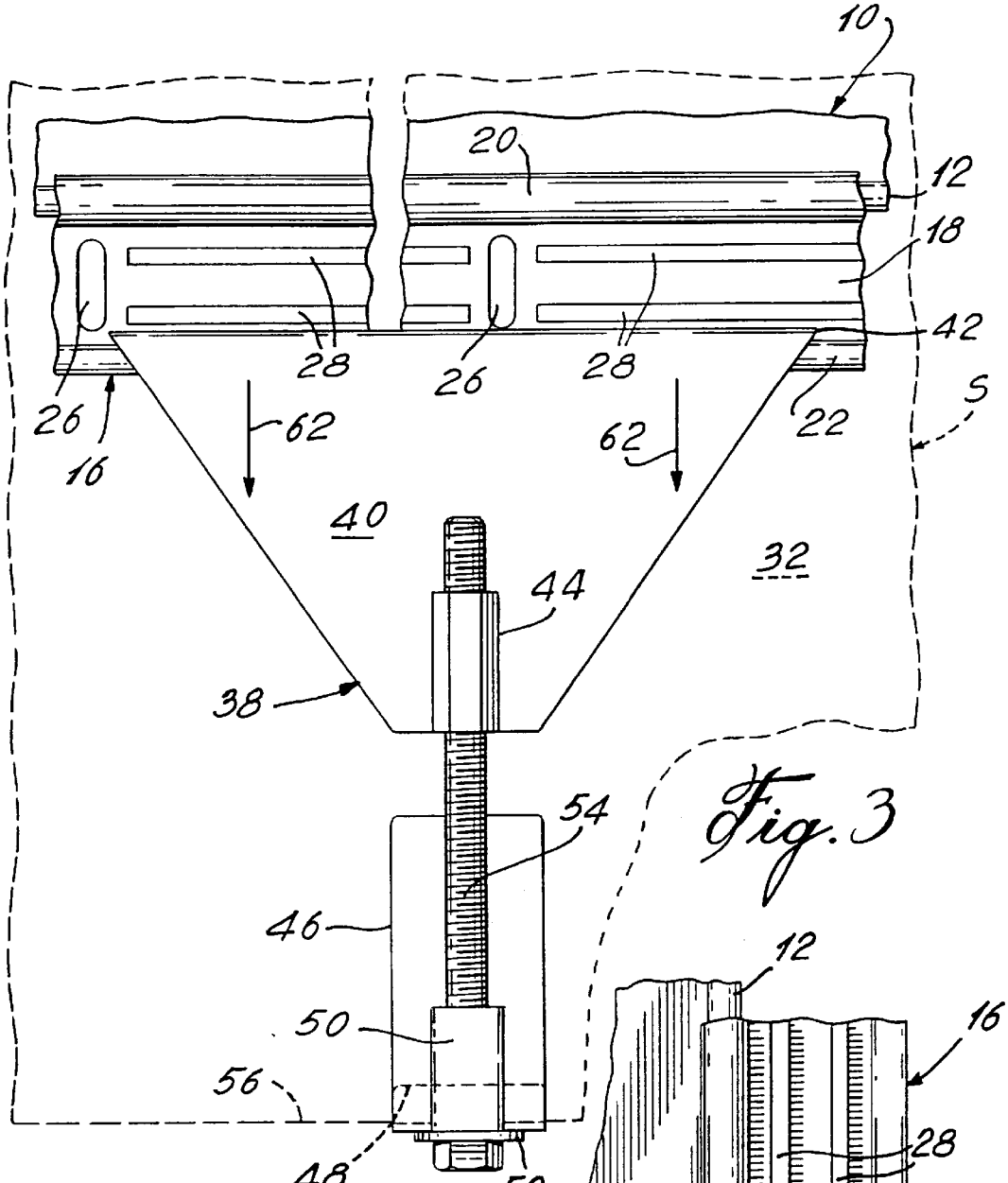
FIG. 3 is an elevational view of part of the frame assembly of the present invention and of the flexible sign to be retained thereby, wherein a tensioning clamp of the present invention is shown enlarged with respect to FIG. 1.

Finally, four frame sections 16 are engaged onto the lower beading 12 of the flexible sign 10, as seen in FIG. 1, and a pulling device is again used for tensioning the flexible sign 10. As seen in FIGS. 1, 2 and 3, a tensioning clamp 38 is herein used for extending the flexible sign 10 downwardly to complete the tensioning thereof. When the flexible sign 10 is pulled downwardly, the vertical side edges thereof and, more particularly, the vertical beadings 12 can longitudinally displace in the cylinders 20 of the vertical end frame sections 16. As in the case of the upper frame sections 16, a series of slides 30 are engaged over the lower frame sections 16 in order to cover the abutment areas thereof.

As seen in FIG. 1, the upper frame sections 16 extend the complete length of the flexible sign 10 as well as the width of the vertical frame sections 16. The vertical end frame sections 16 extend downwardly from underneath the ends of the upper frame sections 16 and downwardly below the vertical beadings 12 of the flexible sign 10 so that the vertical frame sections 16 extend on both sides of the lower frame sections 16, as seen in the lower left corner of the frame assembly A of FIG. 1 and as also seen in the enlarged lower right corner of FIG. 6.

It is noted that, for each of the vertical frame sections 16 and the lower frame sections 16 of the frame assembly A, the frame sections 16 are first loosely assembled to the wall 32 of the semi-trailer S by way of the bolts 34 and nuts 36 and the various frame sections 16 are gradually fixedly secured to the wall 32 once the flexible sign 10 has been tensioned. Accordingly, the oblong openings 26 are provided to allow for a relative movement of the frame sections 16 with respect to the bolts 34 thereby accommodating a displacement of the frame sections 16 and of the beading 12 which occurs during the tensioning of the flexible sign 10.

It is also noted that the slides 30 are retained in position over the abutment areas of adjacent and aligned frame sections 16 by way of the nuts 36 provided at each longitudinal end of the slide 30, as seen in FIG. 4. It is further noted that the slides 30, during the tensioning of the flexible sign 10, maintain the various frame sections 16 in an aligned end-to-end relationship thereby preventing a possible shearing of the flexible sign 10. The bead 14 is made of a substantially hard material such as rope or a solid plastic in order that it does not unduly deform during the tensioning of the flexible sign 10 thereby preventing the beading 12 from being pulled out from the cylinders 20 of the frame sections 16. The slit 24 is provided and positioned in order to allow the flexible sign 10 to extend inwardly of the beading 12 through the cylinders 20 in such a way that the flexible sign 10 extend as close as possible to the wall or panel 32.

In order to tension the flexible sign 10, various stretching or pulling devices can be used such as the aforementioned tensioning clamp 38 which will now be described in more details. As best seen in FIGS. 2 and 3, the tensioning clamp 38 includes a trapezoidal-shaped plate 40 which defines at an outer larger end thereof a hook 42 adapted to engage the inturned lip 22 of the frame sections 16, as best seen in FIG. 2. At an inner narrower end of the plate 40, and on a side thereof opposite the hook 42, there is provided an elongated member 44 defining an inner thread the whole length thereof. The tensioning clamp also includes a L-shaped bracket 46 defining a square hook portion 48 facing the hook 42 of the trapezoidal plate 40. A tubular member 50 is secured to the L-shaped bracket 46 on a side thereof opposite the square hook portion 48 thereof. An enlarged washer 52 is secured at an end of the tubular member 50 opposite the threaded member 44 of the plate 40. A long bolt 54 extends through the tubular member 50 and is threadingly engaged in the threaded member 24.

For using the tensioning clamp 38 to tension the flexible sign 10, the bolt 54 is rotated counterclockwise with respect to the threaded member 44 in order that a distance between the hook 42 and the square hook portion 48 is sufficient to allow the hook 42 to engage the lip 22 of the frame section 16 and to allow the square hook portion 48 to engage a square edge 56 of the semi-trailer S, as best seen in FIG. 2. Then, the long bolt 54 is rotated clockwise as per arrow 58 of FIG. 2 thereby causing a relative movement of the plate 40 towards the L-shaped bracket 46 and, as the L-shaped bracket 46 cannot displace upwardly because of the engagement of the square hook portion 48 thereof with the square edge 56, a rotation of the bolt 54 causes the plate 40 to pull along arrow 60 of FIG. 2 and arrows 62 of FIG. 3 the frame section 16 downwardly and thus also the lower beading 12 of the flexible sign 10 thereby stretching and tensioning the latter.

With reference to FIG. 6, it is readily understood that the beading 12 is interrupted at the corners of the flexible sign 10 in order to allow for the frame sections 16 to be slidably engaged thereon. Also, before fixedly securing the vertical frame section 16 of the second and last vertical beading 12 of the flexible sign 10, it is sometimes easier to insert the lower frame sections 16 and slides 30 on the lower beading 12 as, both vertical frame sections 16 once secured can prevent the lower frame sections 16 from being easily engaged over the lower beading 12.

For tightening the bolts 34 and nuts 36 so as to secure the frame sections 16 to the panel 32, it is proposed that the bolts 34 define at the end of the threaded rod thereof a longitudinal hole 64 of hexagonal cross-section and adapted to receive therein an allen key. A specialized compressed air powered tool having a rotatable socket for engaging the nut 36 and a stationary allen key for engaging the hexagonal hole 64 of the bolt 34 can be used from outside of the semi-trailer S for tightening the bolts 34 and nuts 36. Indeed, once the socket of the specialized tool has been positioned around the nut 36 and the allen key thereof has been introduced in the hexagonal hole 64, compressed air supplied to the tool will cause the socket to rotate while the allen key prevents the bolt 34 from rotating, whereby the nut 36 is rotated relative to the bolt 34 until the frame section 16 is tightly secured to the panel 32 of the semi-trailer S.

Therefore, once all of the frame sections have been fixedly secured to the wall 32 of the semi-trailer S, the flexible sign 10 is adequately stretched and the displacement or fluctuating thereof is substantially limited even under the significant wind forces which result from the tractor trailer 10 displacing at relatively high speed.

The embodiments of the invention in which an exclusive property or privilege is claimed are defined as follows:

1. A combination for tensioning and retaining a flexible sheet-like material in a substantially taut condition to a substantially flat surface, said combination comprising:

at least one frame means for engaging the flexible material, said frame means being adapted for selective fixed securement to the flat surface; and at least one removable tensioning means capable of temporary engagement with said frame means, said tensioning means comprising:

hook means for temporarily engaging said frame means;

engagement means for temporarily fixing said tensioning means relative to the flat surface; and pulling means for selectively causing said hook means to travel toward the engagement means;

wherein said tensioning means is capable of selectively moving said frame means before said frame means is fixedly secured to the flat surface, thereby selectively tensioning the flexible material which is engaged by said frame means;

wherein said frame means can be fixedly secured to the flat surface after adjustment by said tensioning means; and wherein said frame means is capable of retaining the flexible material on the flat surface at a desired tension even after said tensioning means is disengaged from said frame means.

2. The combination according to claim 1 wherein said pulling means comprises a threaded member which is threadably engaged with said hook means and which is rotatably mounted to said engagement means.

3. The combination according to claim 2, wherein said threaded member comprises a bolt.

4. The combination according to claim 1 wherein said frame means comprises:

an open cylinder adapted to receive a bead provided along an edge of the flexible material; and an inturned lip, disposed opposite said open cylinder, for engagement with said hook means.

5. The combination according to claim 4, wherein said frame means comprises a web having a plane rear surface for contact with the flat surface, said open cylinder and said lip extending forwardly of said web, said open cylinder defining a slit adjacent an end of said frame means and directed rearwardly such that, when the bead is received in said open cylinder, the flexible material extends through said slit and towards the flat surface such that the material extends adjacent to the flat surface.

6. The combination according to claim 1, wherein said frame means comprises:

a web having a plane rear surface for contact with the flat surface, said web including an open cylinder adapted to receive a bead provided along an edge of the flexible material, said web being provided with at least two parallel elongated openings extending substantially at right angles to said open cylinder; and bolt means being provided for use through said openings and corresponding holes defined in the flat surface, whereby said frame means can be first loosely attached to the flat surface with said bolt means and cooperating nut means and, after the flexible material has reached said desired tension using said tensioning means, said bolt means can be tightened such as to fixedly secure said frame means to the flat surface.

7. The combination according to claim 6, wherein said frame means further comprises:

ribs provided on a front surface of said web and parallel to said open cylinder; and cover means having a rear surface provided with grooves shaped as to slidably receive said ribs, whereby said cover means can be positioned over abutting ends of a pair of successive frame means.

8. The combination according to claim 7, wherein said openings are oblong for allowing said frame means to displace along the flat surface during tensioning of the flexible material, and wherein said ribs and grooves are dovetail-shaped.

9. The combination according to claim 1, wherein a plurality of said frame means is provided for positioning in succession along each edge of the flexible material.

10. The combination according to claim 1, wherein said frame means define openings; and wherein the combination further comprises bolt means and nut means for use through said openings and corresponding holes defined in the flat surface, said bolt means defining in a free end thereof opposite a head thereof an anti-rotation hole such that said nut means and said bolt means can be tightened for fixedly securing said frame means to the flat surface with a tool having a rotating component adapted to rotatably drive said nut means and a stationary component adapted to engage said anti-rotation hole and thus prevent said bolt means from rotating during rotation of said nut means.

11. The combination according to claim 10, wherein said anti-rotating hole is hexagonal, wherein the rotating component of the tool comprises a socket for engaging said nut means, and wherein the stationary component thereof comprises an allen key for engagement in said anti-rotating hole.

12. The combination according to claim 1 wherein said frame means comprises:

a longitudinally extending central web portion having a bottom surface for contacting the flat surface;

a cylinder portion disposed at a front of said web portion, said cylinder portion being adapted to grip the edge of the flexible material;

at least one longitudinal raised portion extending upward from a top surface of said web portion;

wherein said raised portion is capable of being pulled rearwardly while said cylinder portion grips the flexible material; and wherein said frame member is capable of being fixedly attached to the flat surface while said raised portion is being pulled.

13. The combination according to claim 1 wherein said tensioning means comprises:

a clamp member having a forward hooked portion for engaging said frame means;

a bracket having a rear hooked portion for engaging a fixed object; and a pulling member, threadably engaged with said clamp member and rotatably mounted to said bracket, thereby connecting said clamp member to said bracket, wherein selective rotation of said pulling member causes said clamp to travel toward said bracket, thereby causing said frame means to move toward the fixed object.

14. A frame assembly according to claim 1, wherein said openings are oblong for allowing said frame means to displace along the flat surface during tensioning of the flexible material, and wherein said ribs and grooves are dovetail-shaped.

15. A frame assembly according to claim 14, wherein said open cylinder extends forwardly of said web and defines a slit adjacent an inner end of said web and directed rearwardly such that, when the bead is received in said open cylinder, the flexible material extends through said slit and towards the flat surface such that the material extends adjacent to the flat surface.

16. A device for moving a first object relative to a second object, said device comprising:

a clamp member having a forward hooked portion for engaging the first object;

a bracket having a rear hooked portion for engaging the second object; and a pulling member, threadably engaged with said clamp member and rotatably mounted to said bracket, thereby connecting said clamp member to said bracket, wherein selective rotation of said pulling member causes said clamp to travel toward said bracket, thereby causing said first object to move toward the second object, wherein said bracket further comprises a tubular member in which said pulling member freely rotates.

17. The device according to claim 16 wherein said clamp member comprises a trapezoidal plate having a wide front end and a narrow rear end.

18. A method for attaching flexible sheet-like material in a substantially taut condition to a substantially flat surface, comprising:

securing a first edge of the flexible material to the flat surface;

providing at least one frame means;

providing a tensioning means;

attaching said frame means to a second edge of the flexible material opposite the first edge thereof;

attaching said tensioning means to said frame means;

operating said tensioning means so as to pull said frame means away from the flexible material, thereby tensioning the flexible material between the first and second edges thereof to a desired tension;

fixedly securing said frame means to the flat surface only after the flexible material is under the desired tension; and removing said tensioning means from said frame means;

whereby the desired tension is maintained by said frame means.

19. A method according to claim 18, wherein a plurality of said frame means is provided for securing each edge of the flexible material to the flat surface, and wherein each pair of opposite edges of the flexible material are secured as set forth in claim 18 for the first and second edges.

20. A method according to claim 14, wherein the first edge and opposed third and fourth edges of the material are equipped with frame means; the frame means attached to the first edge and to the third edge being first secured to the flat surface; said tensioning means being used to pull on the frame means attached to the fourth edge with the frame means attached to the fourth edge being fixedly secured to the flat surface after the flexible material is under desired tension along a direction perpendicular to the third and fourth edges; said tensioning means being used to pull on the frame means attached to the second edge with the frame means attached to the second edge being fixedly secured to the flat surface after the flexible material is under desired tension along a direction perpendicular to the first and second edges.

21. A method according to claim 18, wherein said tensioning means includes first and second hook means and a pulling member connected thereto, said first hook means being adapted to temporarily be connected to said frame means, said second hook means being adapted to be temporarily installed in a fixed position with respect to the flat surface, wherein rotation of said pulling member causes said first hook means to translationally travel away from the material thereby pulling on said frame means and on the material up to said desired tension.

22. A method according to claim 18, wherein a bead provided along an edge of the flexible material is inserted in an open cylinder provided at an inner end of said frame means.

23. A method according to claim 18, wherein said frame means comprises at least two parallel elongated openings extending substantially at right angles to the second edge, wherein bolt means are inserted through said openings and corresponding holes defined in the flat surface, wherein said frame means are, prior to tensioning the flexible material, loosely attached to the flat surface with said bolt means and cooperating nut means; and wherein, after the flexible material has reached said desired tension using said tensioning means, said bolt means and said nut means are tightened such as to fixedly secure said frame means to the flat surface.

24. A method according to claim 23, wherein said elongated openings are oblong for allowing said frame means to displace along the flat surface during tensioning of the flexible material.

25. A frame assembly for retaining a flexible sheet-like material in a substantially taut condition to a substantially flat surface, the flexible material having a bead along an edge thereof, said frame assembly being adjusted by a tensioning device, said frame assembly comprising:

a series of frame means, each said frame means comprising:

an open cylinder disposed at an inner end and adapted to receive the bead;

a web having a flat rear surface for contact with the flat surface, said web being provided with at least two parallel elongated openings extending substantially at right angles to said open cylinder; and bolt means for use through said openings and corresponding holes defined in the flat surface, said bolt means including a cooperating nut means;

wherein said frame means can be first loosely attached to the flat surface with said bolt means and cooperating nut means; and, wherein, after the flexible material has reached a desired tension by the tensioning device, said bolt means can be tightened such as to fixedly secure said frame means to the flat surface, thereby retaining the flexible material at said desired tension, wherein said web further comprises ribs disposed on a front surface thereof and parallel to said open cylinder; and wherein said frame assembly further comprises cover means having a rear surface which define grooves shaped to slidably receive said ribs;

whereby said cover means can be positioned over abutting ends of a pair of successive frame means.

* * * * *

UNITED STATES PATENT AND TRADEMARK OFFICE

CERTIFICATE OF CORRECTION

PATENT NO. : 6,041,535
DATED : March 28, 2000
INVENTOR(S) : Graham F. Holloway; Wolfe Vracar It is certified that error appears in the above-identified patent and that said Letters Patent is hereby corrected as shown below:

Item [30] Foreign Application Priority Data is missing and should read
--June 28, 1994 [CA] Canada 2,126,949.
In column 9, line 39,"14" should read --18--.

Signed and Sealed this

Fifth Day of June, 2001

*Attest:*

*Attesting Officer*

Nicholas P. Godici

NICHOLAS P. GODICI

*Acting Director of the United States Patent and Trademark Office*